US008256539B2

(12) United States Patent
Allouche et al.

(10) Patent No.: US 8,256,539 B2
(45) Date of Patent: Sep. 4, 2012

(54) STEERABLE GROUND PIERCING TOOLS

(75) Inventors: Erez N. Allouche, Ruston, LA (US); David Hall, Ruston, LA (US); Michael Swanbom, Dubach, LA (US); Slade Richard, Ruston, LA (US)

(73) Assignee: Louisiana Tech University Research Foundation, Ruston, LA (US)

( * ) Notice: Subject to any disclaimer, the term of this patent is extended or adjusted under 35 U.S.C. 154(b) by 211 days.

(21) Appl. No.: 12/512,233

(22) Filed: Jul. 30, 2009

(65) Prior Publication Data

US 2011/0024196 A1 Feb. 3, 2011

(51) Int. Cl.
*E21B 4/00* (2006.01)
*E21B 10/38* (2006.01)

(52) U.S. Cl. ..... 175/293; 175/51; 175/299; 175/305

(58) Field of Classification Search ..... 175/51, 175/61, 62, 299, 305, 293, 415
See application file for complete search history.

(56) References Cited

U.S. PATENT DOCUMENTS

| | | | | |
|---|---|---|---|---|
| 3,708,023 | A | 1/1973 | Nazarov et al. | |
| 3,826,316 | A | 7/1974 | Bassinger | |
| 4,867,255 | A * | 9/1989 | Baker et al. | 175/61 |
| 5,305,837 | A * | 4/1994 | Johns et al. | 175/61 |
| 6,269,889 | B1 | 8/2001 | Wentworth | |
| 6,283,229 | B1 * | 9/2001 | Wentworth et al. | 175/62 |
| 6,923,270 | B1 | 8/2005 | Randa | |
| 7,066,279 | B2 | 6/2006 | Randa | |
| 7,086,808 | B2 | 8/2006 | Wentworth et al. | |

* cited by examiner

*Primary Examiner* — Cathleen Hutchins
(74) *Attorney, Agent, or Firm* — Pauley Petersen & Erickson

(57) ABSTRACT

A steerable ground piercing tool includes an elongated outer housing having a lengthwise extending bore and an inner assembly at least in part disposed within the outer housing. The inner assembly includes a rotatable chisel having a longitudinally extending shaft at least in part disposed within the housing bore. The chisel has a first end defining an asymmetric tip and a second end defining a first impact surface for receiving a reciprocating action impact to drive the tool through the ground. The inner assembly further includes a conversion mechanism to selectively convert upon activation thereof at least a first portion of the reciprocating action imparted to the first impact surface into combined reciprocation and rotation of the tool.

7 Claims, 9 Drawing Sheets

STEERABLE GROUND PIERCING TOOLS

BACKGROUND OF THE INVENTION

Field of the Invention

This invention relates generally to ground piercing tools and, more particularly, to ground piercing tools that are steerable through the ground.

Ground piercing tools, also known as "impact moles," are perhaps the most commonly used devices around the world for no-dig installation of small diameter pipes and conduits. Reasons for the popularity of ground piercing tool/impact mole devices include relatively low capital and maintenance costs, minimal training requirements for operators and simplicity of operation.

Such ground piercing tools are typically pneumatically-operated and are in operational assemblies for the routing of pipelines, power lines, information transmission cables, e.g., fiber optic cables, and the like below ground surface, i.e., in and through the ground, while minimizing surface disruption. Typically, such ground piercing tools include an elongated, bullet-shaped housing or body having a tapered or shaped tip or nose at a front end for piercing of the ground. A reciprocating hammer, striker or the like is included to impart impacts to drive the tool through the ground. A distribution system such as for air or other selected compressed fluid is typically used to appropriately reciprocate the hammer in response to a supply of compressed air or other selected fluid.

While the unit cost of laying service pipes is relatively low, such projects, due to their large number, typically account for a large majority of the capital investment and maintenance activities of typical natural gas supply companies. A construction methodology referred to as "keyhole" technology or style of maintenance has been developed as part of a strategic focus to reduce the cost of constructing, expanding and maintaining natural gas distributions systems in urban areas.

In accordance with a typical keyhole operation, a vertical hole or shaft is drilled, made or otherwise formed through the ground surface, paved or otherwise, and into the ground to form an access point, e.g., a "keyhole," to an existing service or supply line. The keyhole construction methodology presents significant advantages over open-cut excavations in terms of reinstatement costs and construction time while also reducing adverse impact on the surrounding environment (such as by reducing or minimizing traffic interruption, visual impacts, noise, etc.).

Customary current keyhole construction methodology involves ground piercing tools, pavement coring systems, a hydro-vacuum excavation apparatus and specifically developed long-handled tools such as to manipulate the service line and other components from the surface. For example, long-handled tools can be used to connect a branch line to the supply line.

A shortcoming of such a system is the non-steerable nature of traditional ground piercing tools. For example, with operation in stony or layered soils, steering modifications or corrections may be desired or needed in order for the tool to proceed along a specifically desired path and/or in a specifically desired direction. This can be particularly problematic when there is a need to for the piercing tool to arrive or meet a relatively small opening or access point with limited elevation tolerances, as typically required with keyhole operations.

Moreover, when the piercing tool is not recoverable through the keyhole opening, recovery of the tool requires reversal of the path followed by the tool such as to significantly increase, e.g., nearly double, the process time.

A steerable ground piercing tool/mole has been developed that utilizes a steering mechanism manually operated by the user at the ground surface. In particular, the technology employs an asymmetric, tapered head on the end of a pneumatically operated tool that is powered by a piston housed within a casing and joined to an air supply hose. The steering mechanism for this tool is operated manually by the user and is accomplished by rotating the air hose with a hydraulic tensioning unit called a torquer. The hose is enforced with a wire frame to allow the torque applied by the operator to be transmitted to the tool body. As the operator turns the hose, the tapered head turns accordingly and thus redirects the direction of travel for the tool. The steering is controlled by measuring the amount of turn being done via the hydraulic torquer clamp.

Such steering operation can be subject to certain limitations or shortcomings. For example, the tool constantly needs to be steered, as it has no straight line direction of travel. The need for operator interface increases the possibility of steering error. The accuracy and repeatability of such steering operation can be unreliable. Also, due to the need for a substantial separation distance between the sonde and the hammer, such tools can commonly measure nearly seven feet in length and four inches in diameter, dimensions that are substantially larger than most non-steerable impact moles (such as commonly measure three feet in length and 1¾ inches in diameter). Thus, there is a need and a demand for a ground piercing tool that provides desired steerability while simplifying operation and use.

SUMMARY OF THE INVENTION

The present invention provides an improved ground piercing tool.

In certain specific aspects, the invention provides ground piercing tools affording improved steerability.

In one embodiment, the invention provides a steerable ground piercing tool that includes an elongated outer housing having a lengthwise extending bore and an inner assembly at least in part disposed within the outer housing. The inner assembly includes a rotatable chisel having a longitudinally extending shaft at least in part disposed within the housing bore. The chisel has a first end defining an asymmetric tip and a second end defining a first impact surface for receiving a reciprocating action impact to drive the tool through the ground. The inner assembly further includes a conversion mechanism to selectively convert upon activation thereof at least a first portion of the reciprocating action imparted to the first impact surface into combined reciprocation and rotation of the tool.

In one particular embodiment, the invention comprehends such a steerable ground piercing tool additionally including a reciprocating hammer to impart impacts to the first impact surface for driving the tool through the ground. The hammer is at least in part disposed for reciprocating action within the housing bore. The hammer includes a head portion with a plurality of teeth disposed on the impact surface thereof.

In this tool, the first impact surface is in part composed of a chisel turn rotator with a plurality of teeth disposed thereon. The teeth of the chisel turn rotator interact with the teeth of the hammer to drive the chisel forward. The conversion mechanism includes a return stroke rotator held in fixed translational position within the tool and with the hammer at least in part disposed within the return stroke rotator. The return stroke rotator includes a plurality of teeth disposed thereon such that the return stroke rotator teeth desirably can interact with the chisel turn rotator teeth.

Upon application to the hammer of a fluid compressed to a sufficiently high pressure and with forward motion of the hammer, the hammer teeth interact with the chisel turn rotator teeth to advance the chisel sufficiently forward that each chisel turn rotator tooth clears an adjacent return stroke rotator tooth and to convert the first portion of the reciprocating action imparted to the first impact surface into combined reciprocation and rotation of the tool. However, upon application to the hammer of a fluid compressed to an insufficiently high pressure and with forward motion of the hammer, the hammer teeth interact with the chisel turn rotator teeth to advance the chisel forward without the chisel turn rotator teeth clearing adjacent return stroke rotator teeth.

In another particular embodiment, the invention comprehends such a steerable ground piercing tool wherein the conversion mechanism includes a head element interposed between the asymmetric tip and a subsequent portion of the chisel shaft. A first front tooth ring having rearward facing teeth is disposed within the head element. A second front tooth ring is disposed about the chisel rearwardly adjacent the head element. The second front tooth ring has forward facing teeth to selectively interact with the rearward facing teeth of the front tooth ring. A clutch assembly and spring housing combination is disposed about the chisel rearwardly adjacent the second front tooth ring. A first rear tooth ring having rearward facing teeth is disposed about the chisel rearwardly adjacent the clutch assembly and spring housing combination. A second rear tooth ring is disposed adjacent the second end of the chisel. The second rear tooth ring has forward facing teeth to selectively interact with the rearward facing teeth of the first rear tooth. A spring is disposed about the chisel shaft within the clutch assembly and spring housing combination adjacent the second end of the chisel.

Upon the imparting of impacts to the second end of the chisel sufficient to advance the chisel shaft forward and for the second rear tooth ring teeth to interact with the first rear tooth ring teeth, a first segment of the reciprocating action imparted to the first impact surface is converted into combined reciprocation and rotation of the tool. Upon the rearward portion of the reciprocating action, the spring drives the second front tooth ring teeth to interact with the first front tooth ring teeth to convert a second segment of the reciprocating action into combined reciprocation and rotation of the tool.

In one more specific embodiment, the clutch assembly and spring housing combination includes a clutch assembly disposed about the chisel rearwardly adjacent the second front tooth ring. The clutch assembly includes a clutch cap with a clutch disposed therein. The clutch assembly and spring housing combination further includes a spring casing joined to the clutch cap with the clutch disposed therebetween.

In one embodiment, the clutch cap includes a forward facing surface having the second front tooth ring integral therewith. The spring casing includes a rearward facing surface having the first rear tooth ring integral therewith. Upon the imparting of the impacts to the second end of the chisel sufficient to advance the chisel shaft forward and for the second rear tooth ring teeth to interact with the spring casing teeth to convert a first segment of the reciprocating action imparted to the first impact surface into combined reciprocation and rotation of the tool and, upon the rearward portion of the reciprocating action, the spring drives the clutch cap teeth to interact with the first front tooth ring teeth to convert a second segment of the reciprocating action into combined reciprocation and rotation of the tool.

In another embodiment, the tool of additionally includes a spring assembly disposed at least in part within the tool outer housing to move the rotatable chisel to an at rest state in the absence of imparting of impacts thereon. The spring assembly has a spring element within a spring housing disposed about the rotatable chisel. The conversion mechanism involves the chisel shaft having a circumference with a series of parallel grooves formed therein and a selected one of the spring housing and the tool outer housing having a ratcheting mechanism to interact with the series of parallel grooves formed in the chisel shaft.

In another aspect, the invention provides a combination of a steerable ground piercing tool, such as herein described, with a compressed fluid distribution system to impart reciprocating action in response to a supply of compressed fluid, wherein, the fluid can be alternatively selectively compressed to either:

a sufficiently high pressure to convert the first portion of the reciprocating action imparted to the first impact surface into combined reciprocation and rotation of the tool and the tool pierces the ground in a straight path, or an insufficiently high pressure to convert the first portion of the reciprocating action imparted to the first impact surface into combined reciprocation and rotation of the tool and the tool pierces the ground in a curvilinear path.

Other objects and advantages will be apparent to those skilled in the art from the following detailed description taken in conjunction with the appended claims and drawings.

DESCRIPTION OF PREFERRED EMBODIMENTS

Figure 1:
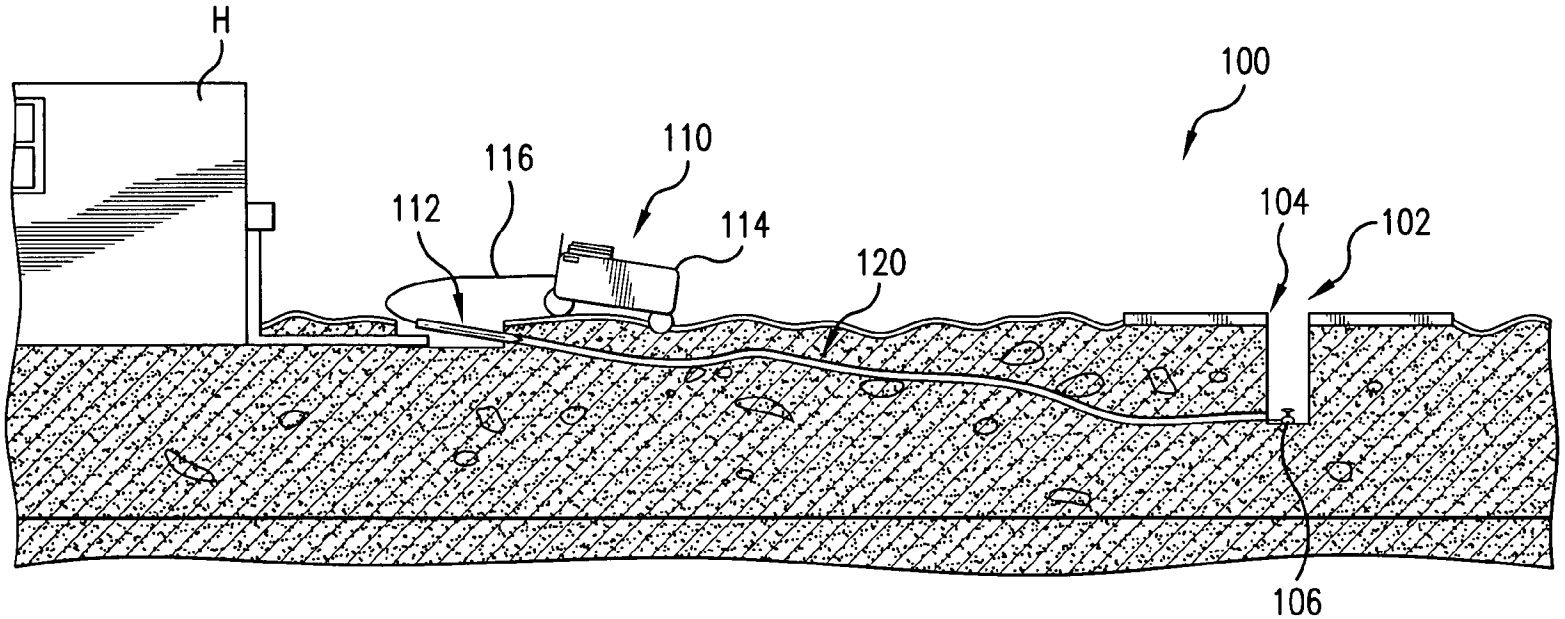
FIG. 1 is a schematic diagram of a keyhole operation in accordance with one aspect of the invention.

FIG. 1 shows a keyhole operation, generally designated by the reference numeral 100, in accordance with one aspect of the invention. The keyhole operation 100 includes a vertical hole or shaft 102 drilled, made or otherwise formed through the ground surface 104. The vertical hole 102 forms an access point to an existing service or supply line 106. As discussed above, such a vertical hole is commonly referred to as a "keyhole."

A steerable ground piercing tool assembly, generally designated by the reference numeral 110, is provided to permit the underground accessing of the supply line 106 such as for the installation of a branch line extending between the supply line 106 and a location spaced therefrom such as a house H, shown in FIG. 1. The steerable ground piercing tool assembly 110, appropriately situated near the house H, includes a steerable ground piercing tool 112 in accordance with the invention and described in greater detail below. The assembly also includes a compressor unit 114 and associated accessories including a supply line 116 such as to provide a supply of compressed fluid to the steerable ground piercing tool 112 and impart reciprocating action therein. As described in greater detail below, the ground piercing tool 112 is desirably steered through the ground to form an underground path 120 to the supply line 106 at the keyhole 102.

Figure 2:
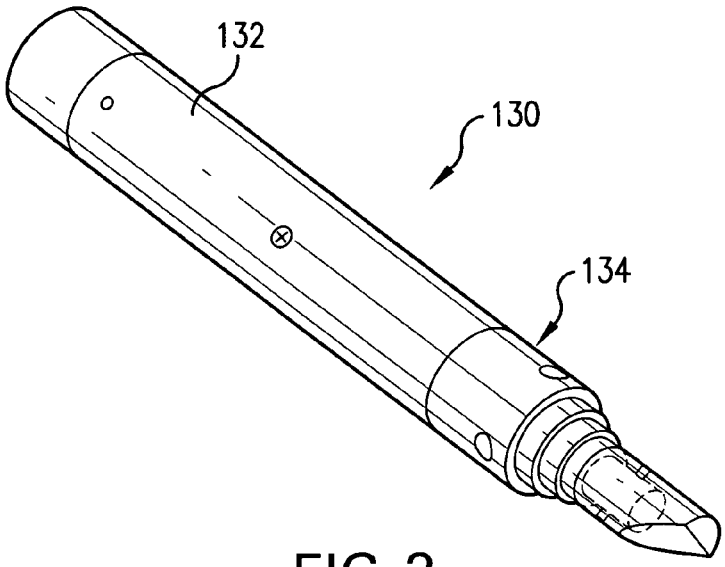
FIG. 2 is a perspective view of a steerable ground piercing tool in accordance with one embodiment of the invention.
Figure 3:
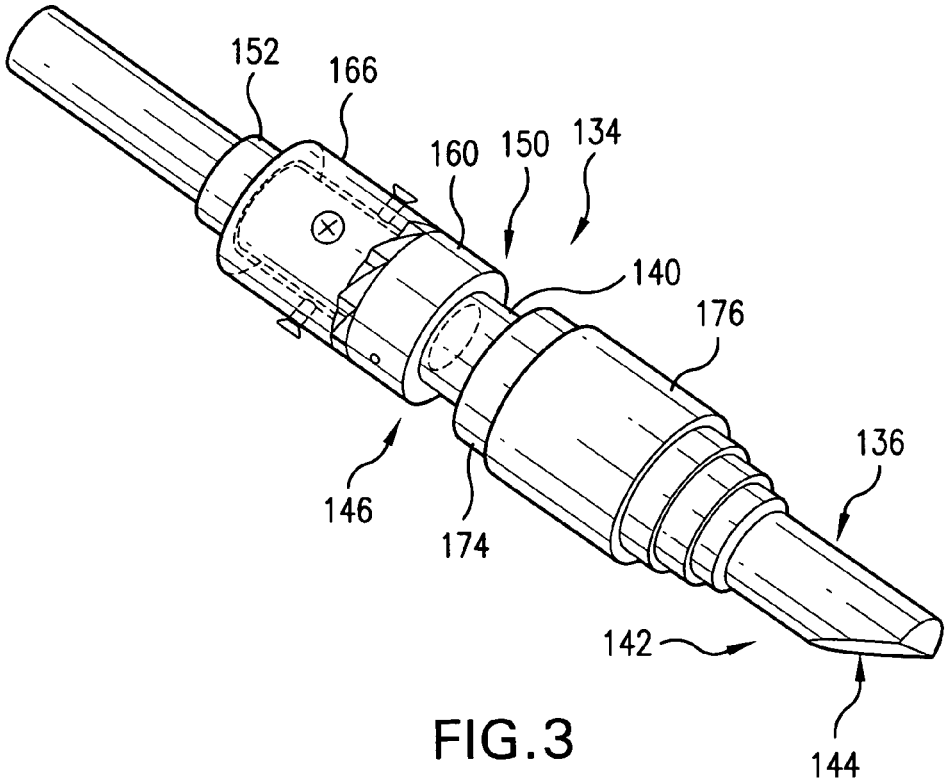
FIG. 3 is a fragmentary perspective view of the steerable ground piercing tool shown in FIG. 2 with the outer housing element not shown to permit viewing of inner components.
Figure 4:
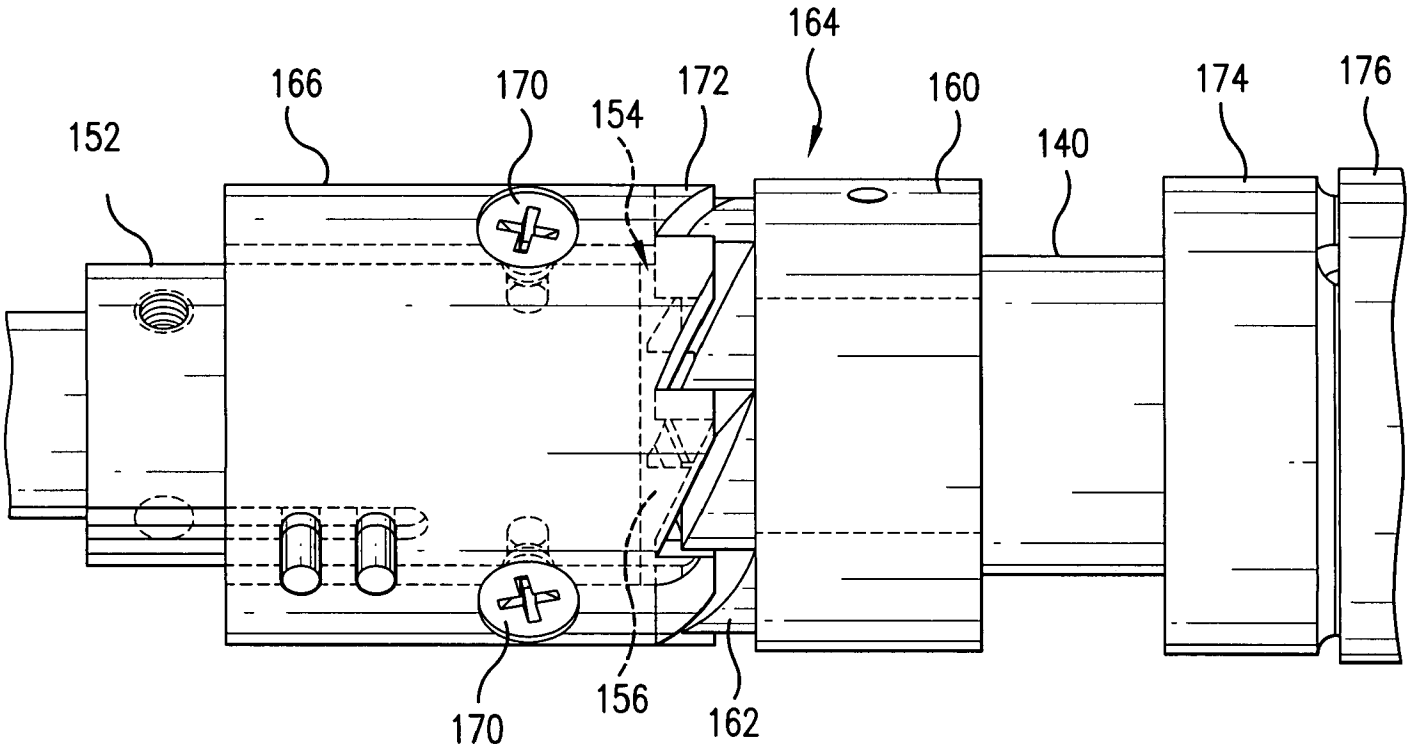
FIG. 4 is fragmentary side view of the inner assembly of the steerable ground piercing tool shown in FIGS. 2 and 3.

Turning to FIGS. 2-4, there is illustrated a steerable ground piercing tool 130 in accordance with one embodiment of the invention. The steerable ground piercing tool 130 includes an elongated outer housing or sleeve 132 and an inner assembly, generally designated by the reference numeral 134 and more particularly shown in FIG. 3.

As will be appreciated, suitable elongated outer housings or sleeves typically have or form a lengthwise extending bore and such as may house or contain at least a portion of the tool inner assembly disposed therewithin.

As shown in FIG. 3, the inner assembly 134 includes a rotatable chisel 136 having a longitudinally extending shaft 140. The chisel 136 has a first end 142 that defines an asymmetric tip 144 and a second end 146 that defines a first impact surface 150.

The tool 130 includes a reciprocating hammer 152 such as at least in part disposed for reciprocating action within the housing, particularly within the bore thereof. In practice, the reciprocating action of the hammer is at least in part pneumatically imparted, as is known in the art such as in response to a supply of compressed fluid provided via a compressed fluid distribution system such as identified above. The hammer 152 has a head portion 154 forming an impact surface with a plurality of teeth, e.g., "hammer teeth" 156, disposed thereon. In operation, the reciprocating hammer 152 imparts impacts to the first impact surface 150 for driving the tool 130 through the ground.

The first impact surface 150 includes or is at least in part formed by a chisel turn rotator 160 having a plurality of teeth 162 disposed thereon. In operation, the chisel turn rotator teeth 162 interact with the hammer teeth 156 to drive the chisel 136 forward.

The tool 130 also includes a conversion mechanism, generally designated by the reference numeral 164, to selectively convert upon activation thereof at least a first portion of the reciprocating action imparted to the first impact surface 150 into combined reciprocation and rotation of the tool 130. The conversion mechanism 164 includes a return stroke rotator 166 (illustrated in FIG. 3 in see-through) held in fixed translational position within the tool 130 via the fasteners 170. The hammer 152 is at least in part disposed within the return stroke rotator 166. Thus, the hammer teeth 156 are sometimes referred to as "inner teeth." The return stroke rotator 166 has a plurality of teeth 172 disposed thereon. The return stroke rotator teeth 172 are designed and adapted to interact with the chisel turn rotator teeth 162.

The tool 130 further includes a spring bushing 174 and a stepped cone header element 176 such as forms a transition between the body of the tool and chisel tip 144.

In operation, upon application to the hammer 152 of a fluid compressed to a sufficiently high pressure and thus upon activation of the conversion mechanism 164, with forward motion of the hammer 152, the hammer teeth 156 interact with the chisel turn rotator teeth 162 to advance the chisel 136 sufficiently forward that each chisel turn rotator tooth clears an adjacent return stroke rotator tooth and to convert a first portion of the reciprocating action imparted to the first impact surface 150 into combined reciprocation and rotation of the tool 130. With such operation, the tool 130, particularly the chisel 136, typically rotates on the rearward motion of the reciprocating hammer 152. As a result of such rotation and the presence of the asymmetric tip 144 at the chisel first end 142, the tool 130 will pierce the ground in a generally straight line path.

However, upon application to the hammer 152 of a fluid compressed to an insufficiently high pressure, and thus in the absence of activation of the conversion mechanism 164, with forward motion of the hammer 152, the hammer teeth 156, e.g., the inner teeth, interact with the chisel turn rotator teeth 162 to advance the chisel 136 forward without the chisel turn rotator teeth 162 clearing adjacent return stroke rotator teeth 172. As a result, the tool 130 pierces the ground in a generally curvilinear path.

As will be appreciated by those skilled in the art and guided by the teachings herein provided, a steerable ground piercing tool in accordance with the invention, such as the tool 130, can be constructed such that activation of the conversion mechanism to selectively convert at least a portion of the reciprocating action imparted to the first impact surface into combined reciprocation and rotation of the tool occurs at a particularly selected pressure. For example, in accordance with one preferred embodiment, it has been found advantageous to select and operate a steerable ground piercing tool in accordance with the invention and such as shown in FIGS. 2-4 such that an operating pressure in the range of about 85 psig to about 90 psig is sufficient for activation thereof such that a portion of the reciprocating action imparted to the first impact surface into combined reciprocation and rotation of the tool.

While the tool 130 advantageously selectively converts the reciprocating action imparted to the first impact surface into combined reciprocation and rotation of the tool in response to application of a fluid compressed to a sufficiently high pressure and thus permits the tool to be appropriately steered through the ground, the particular design and construction of the tool 130 may result in a tool that is longer than has been customary and such as may be undesired for particular applications.

Figure 5:
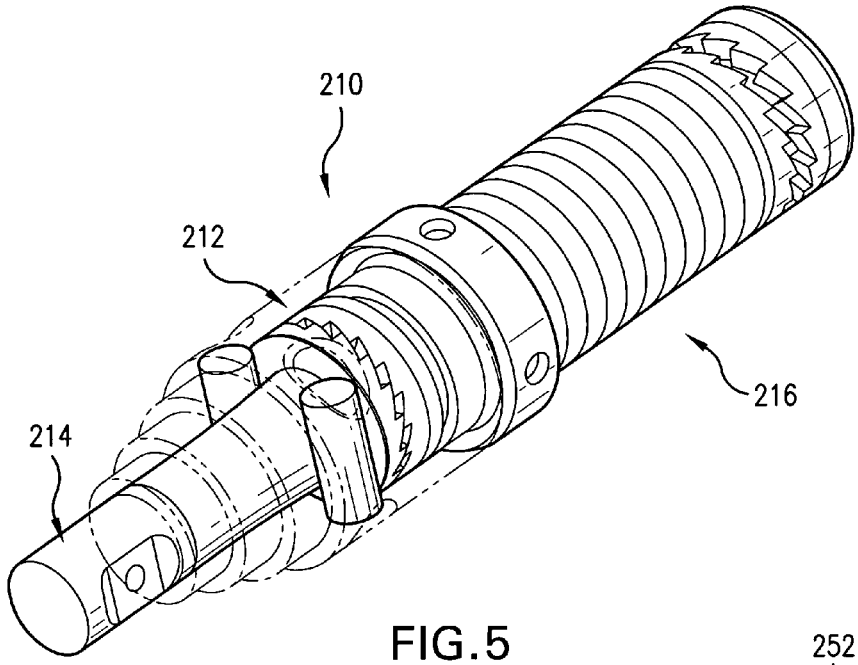
FIG. 5 is a perspective view of a steerable ground piercing tool in accordance with another embodiment of the invention.
Figure 6:
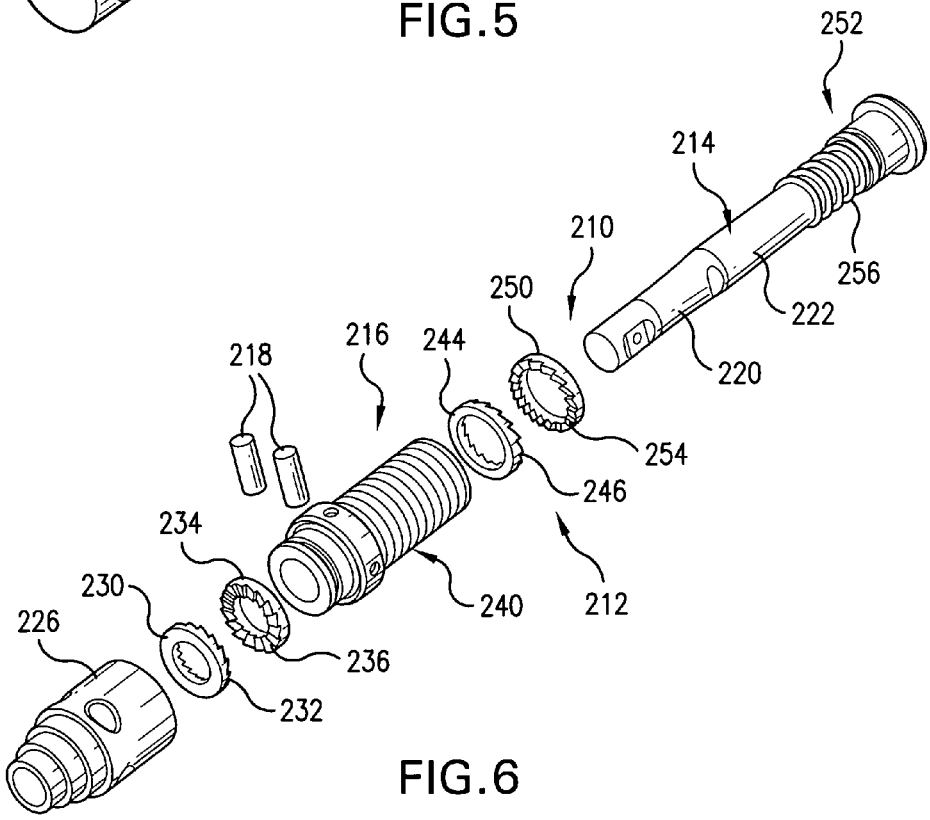
FIG. 6 is a partially exploded perspective view of the steerable ground piercing tool shown in FIG. 5.

FIGS. 5 and 6 illustrate a steerable ground piercing tool 210, more particularly the inner assembly 212 thereof, in accordance with another embodiment of the invention and such as may provide or result in an arrangement of lesser length or more compact form as may be desired in particular applications. As will be appreciated, the tool 210 may desirably include a corresponding or associated appropriate outer housing or sleeve, such as similar to that described above (not here shown).

The assembly 212 includes a rotatable chisel 214, a conversion mechanism 216, and may, if desired contain or include one or more magnets or the like elements 218 such as may be desired for above-ground tip rotation detection. The rotatable chisel 214 is composed of a chisel shaft tip 220 joined to a chisel shaft 222. An asymmetric tip, such as described above and not here shown, is joined to a chisel shaft tip 220.

Figure 7:
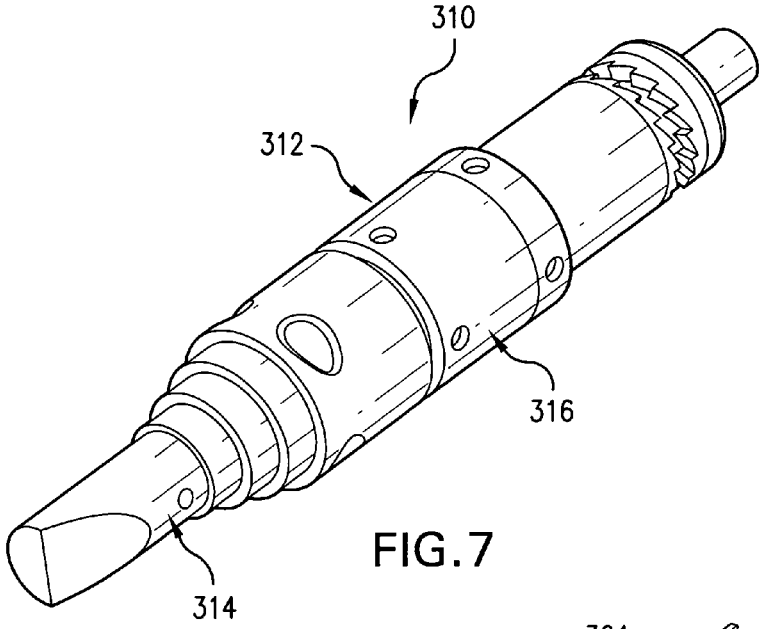
FIG. 7 is a perspective view of a steerable ground piercing tool in accordance with another embodiment of the invention.
Figure 8:
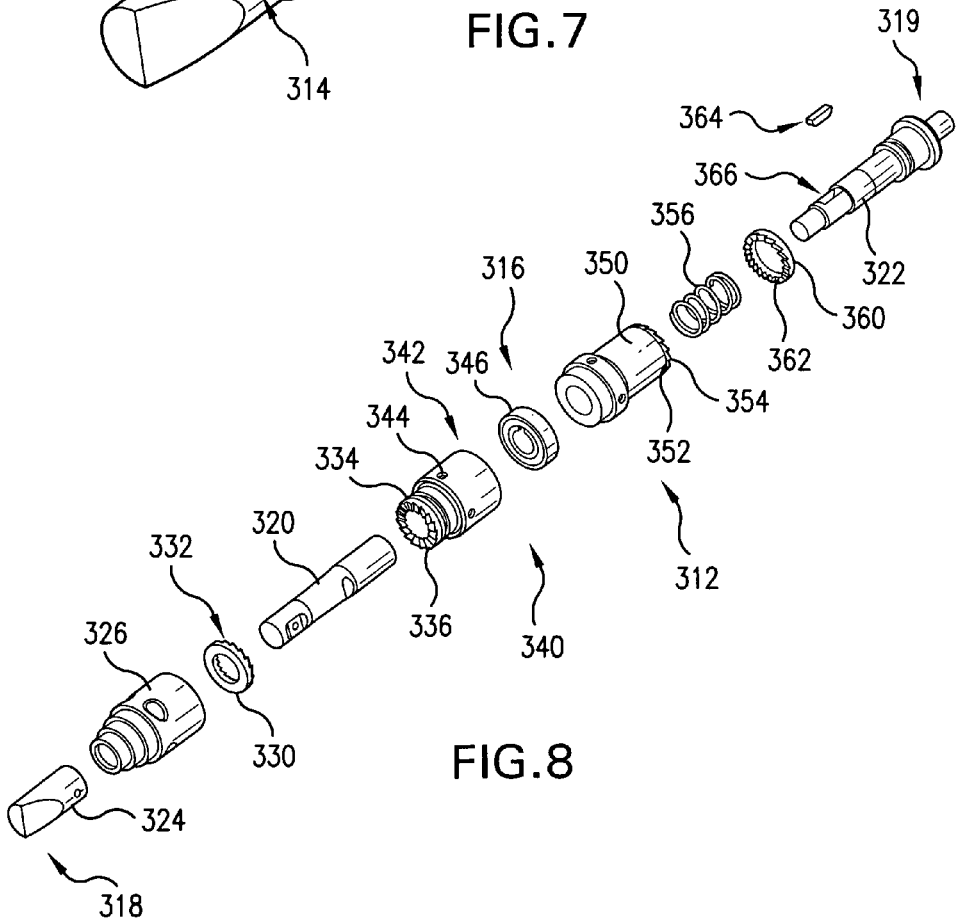
FIG. 8 is a partially exploded perspective view of the steerable ground piercing tool shown in FIG. 7.

The conversion mechanism 216 includes a head element 226, such as in the form of a stepped cone, such as may desirably be interposed between the asymmetric tip and the chisel shaft tip 220. A first front tooth ring 230 having rearward facing teeth 232 is disposed within the head element 226. A second front tooth ring 234 is disposed about the chisel 214 rearwardly adjacent first front tooth ring 230. The second front tooth ring 234 has forward facing teeth 236 to selectively interact with the rearward facing teeth 232 of the first front tooth ring 230. A clutch assembly and spring casing or housing combination 240, described in greater detail below with reference to the embodiment of FIGS. 7 and 8, is disposed about the chisel 214 rearwardly adjacent the second front tooth ring 234. A first rear tooth ring 244, having rearward facing teeth 246, is disposed about the chisel 214 rearwardly adjacent the clutch assembly and spring casing combination 240. A second rear tooth ring 250 is disposed adjacent the chisel second end 252. The second rear tooth ring 250 has forward facing teeth 254 to selectively interact with the rearward facing teeth 246 of the first rear tooth ring 244. A spring 256 is disposed about the chisel shaft 222 within the clutch assembly and spring housing combination 240 adjacent the chisel second end 252.

In operation, upon the imparting of impacts rearward of the chisel second end 252 sufficient to advance the chisel shaft 222 forward and for the second rear tooth ring teeth 254 to interact with the first rear tooth ring teeth 246 to convert a first segment of the reciprocating action imparted to the chisel second end 252, e.g., an impact surface, into combined reciprocation and rotation of the tool 210, and upon the rearward portion of the reciprocating action, the spring 256 drives the second front tooth ring teeth 236 to interact with the first front tooth ring teeth 232 to convert a second segment of the reciprocating action into combined reciprocation and rotation of the tool 210.

FIGS. 7 and 8 illustrate a steerable ground piercing tool 310 in accordance with another embodiment of the invention. The steerable ground piercing tool 310 in many respects is similar to the steerable ground piercing tool 210 described above. More particularly, the steerable ground piercing tool 310 includes a rotatable chisel 314 and a conversion mechanism, generally designated by the reference numeral 316. Further, the tool 310 may desirably include a corresponding or associated appropriate outer housing or sleeve, such as similar to that described above (not here shown).

The rotatable chisel 314 has a first end 318 and a second end 319 and is composed of a chisel shaft tip 320 joined to a chisel shaft 322, with an asymmetric tip 324 joined to a chisel shaft tip 320 and generally forming the chisel first end 318.

The steerable ground piercing tool 310, also similar to the steerable ground piercing tool 210 described above, includes components such as a head element 326, such as in the form of a stepped cone. A first front tooth ring 330 having rearward facing teeth 332 is disposed within the head element 326 such as via a press fit. A second front tooth ring 334 is disposed about the chisel 314 rearwardly adjacent the first front tooth ring 330. The second front tooth ring 334 has forward facing teeth 336 to selectively interact with the rearward facing teeth 332 of the first front tooth ring 330.

A clutch assembly and spring casing or housing combination, generally designated by the reference numeral 340, includes a clutch assembly 342 including a clutch cap 344 with a clutch 346, e.g., a unidirectional clutch, disposed therein such as via a press fit, is disposed about the chisel 314 rearwardly adjacent the second front tooth ring 334. The clutch assembly and spring casing combination 340 further includes a spring casing or housing 350 disposed about the chisel 314 rearwardly adjacent the clutch assembly 342. The spring housing 350 can be connected or joined to the clutch cap 344, such as via appropriate threading, with the clutch 346 interposed therebetween.

A first rear tooth ring 352, having rearward facing teeth 354, is disposed about the chisel 314 rearwardly integrally adjacent the spring casing 350. A spring 356 is disposed about the chisel 314 such as within the spring housing 350 and adjacent the chisel second end 319. A second rear tooth ring 360 is disposed about the chisel 314 adjacent the chisel second end 319. The second rear tooth ring 360 has forward facing teeth 362 to selectively interact with the rearward facing teeth 354 of the first rear tooth ring 352.

The steerable ground piercing tool 310 primarily differs from the steerable ground piercing tool 210 described above, in that the second front tooth ring 334 is integrally formed with the clutch cap 332 and the first rear tooth ring 352 is integrally formed with the spring casing 350. As will be appreciated by those skilled in the art and guided by the teachings herein provided, the broader practice of the invention is not necessarily so limited as, for example, the invention may be practiced via an alternative embodiment where only one of the second front or first rear tooth rings is so integrally formed.

A key 364, appropriately placed in a keyhole 366, such as situated in the shaft 322 secures the assembly.

In operation, upon the imparting of impacts rearward of the chisel second end 319 sufficient to advance the chisel shaft 322 forward and for the forward facing teeth 362 of the second rear tooth ring 360 to interact with the spring casing teeth 354 to convert a first segment of the reciprocating action imparted to the chisel second end 319, e.g., an impact surface, into combined reciprocation and rotation of the tool 310 and, upon the rearward portion of the reciprocating action, the spring 356 drives the clutch cap teeth 336 to interact with the first front tooth ring teeth 332 to convert a second segment of the reciprocating action into combined reciprocation and rotation of the tool 310.

Figure 9:
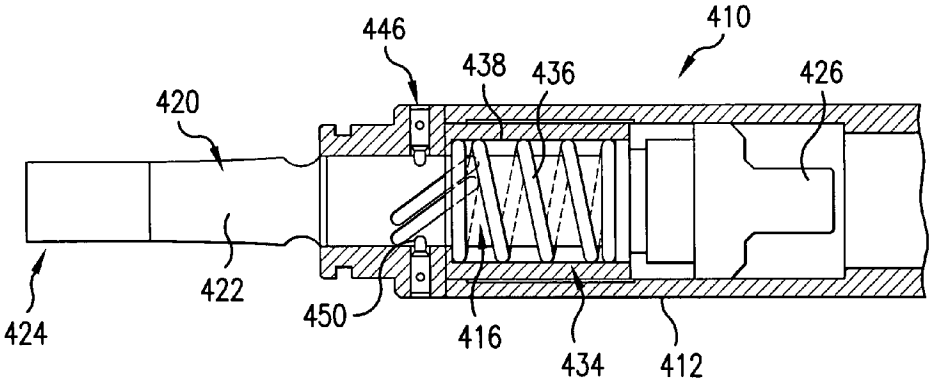
FIG. 9 is a fragmentary side view schematic of a steerable ground piercing tool in accordance with another embodiment of the invention, with the tool in a relaxed position.
Figure 10:
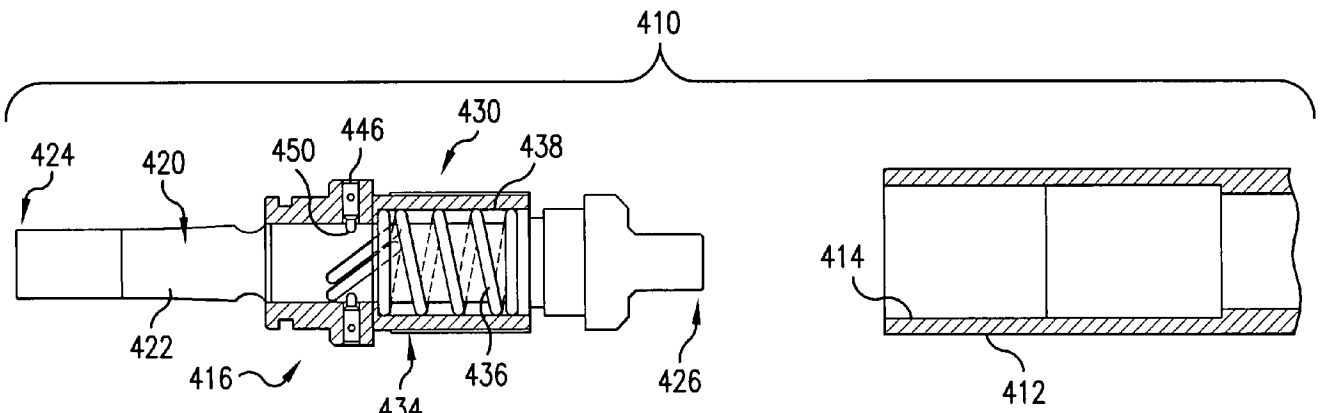
FIG. 10 is a partially exploded side view schematic of the steerable ground piercing tool shown in FIG. 9.

Turning now to FIGS. 9 and 10, there is illustrated a steerable ground piercing tool 410 in accordance with yet another embodiment of the invention. As will be detailed in greater detail below, the steerable ground piercing tool 410 advantageously is of simplified design and operation such as by either or both reducing the number of component parts and/or reducing the complexity of the manufacture of the component parts thereof. In addition, the steerable ground piercing tool reduces reliance on point-to-point loading of teeth gears and the like and such as may result in or produce a greater than desired rate of wear on component parts.

The steerable ground piercing tool 410 includes a mole body or outer housing 412. The outer housing 412 is generally elongated and has a lengthwise extending bore 414.

An inner assembly 416 is at least in part disposed within the outer housing 412. The inner assembly 416 includes a rotatable chisel 420 having a longitudinally extending shaft 422 at least in part disposed within the housing bore 414. The chisel 420 has a first end 424 defining an asymmetric tip and a second end 426 defining a first impact surface for receiving a reciprocating action impact to drive the tool 410 through the ground.

As will be detailed below, the inner assembly 416 also includes a conversion mechanism, generally designated by the reference numeral 430, to selectively convert upon activation thereof at least a first portion of the reciprocating action imparted to the first impact surface, e.g., the chisel second end 426, into combined reciprocation and rotation of the tool 410.

The steerable ground piercing tool 410 includes a spring assembly 434 disposed at least in part within the tool outer housing 412. The spring assembly 434 includes a spring element 436 within a spring housing 438 disposed about the rotatable chisel 420. The spring assembly 434 desirably functions to move the rotatable chisel 420 to an at rest state in the absence of imparting of impacts thereon.

Figure 11:
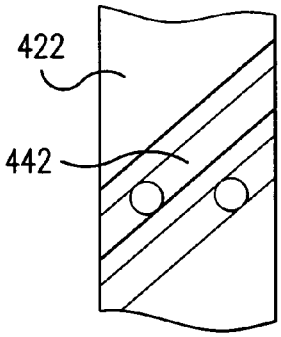
FIG. 11 is a simplified fragmentary top view of the chisel shaft of the steerable ground piercing tool shown in FIG. 9.
Figure 12:
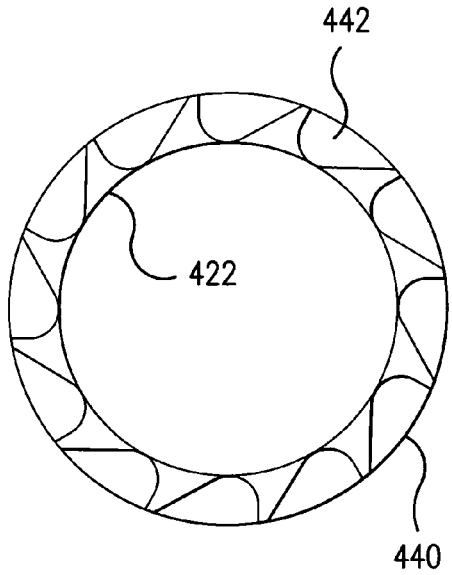
FIG. 12 is a cross-sectional of the portion of the chisel shaft of the steerable ground piercing tool shown in FIG. 11.

As perhaps best seen by reference to FIGS. 11 and 12, the chisel shaft 422 has a circumference 440 with a series of parallel grooves 442 formed therein. The chisel shaft 422 is shown in FIG. 12 as having 12 such grooves. As will be appreciated by those skilled in the art and guided by the teachings herein provided, a greater or lesser number of grooves can be employed as may be desired for particular applications.

Figure 13:
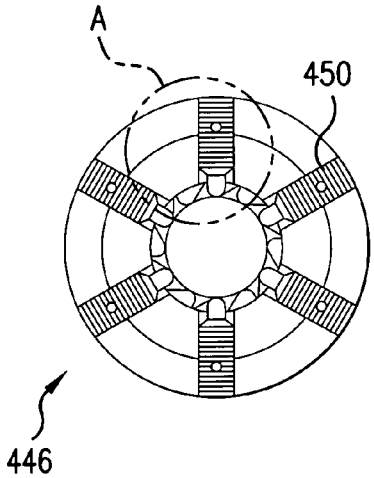
FIG. 13 is a simplified schematic view of the steerable ground piercing tool shown in FIG. 9 and taken along the line 13-13.
Figure 14:
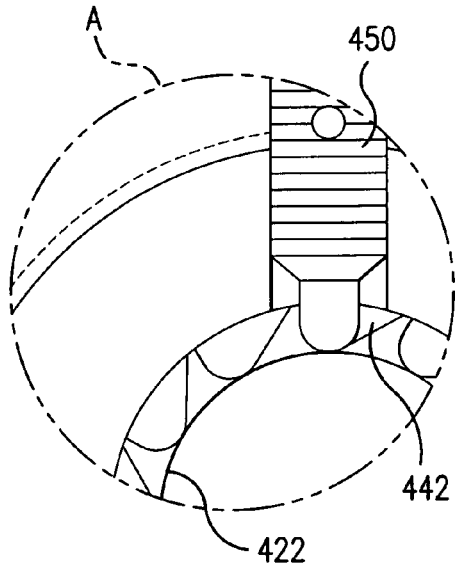
FIG. 14 is an enlarged view of the portion of steerable ground piercing tool shown in FIG. 13 and within the circle A.

Returning to FIGS. 9 and 10, the spring housing 438 at least in part includes a ratcheting mechanism 446 to interact with the series of parallel grooves 442 formed in the chisel shaft 422. More specifically and as shown in greater detail in FIGS. 13 and 14, the ratcheting mechanism 446 is composed of a plurality of contact elements 450, such as in the form of round nose spring plungers, disposed about an inner circumference of the spring housing 438. For example, the spring plungers can be designed to screw into the spring housing. A different one of the contact elements 450 is in interaction contact with a different one of the series of parallel grooves 442 formed in the chisel shaft 422.

The ratcheting mechanism 446 functions such that when impacts are imparted to the chisel second end 426 sufficient to advance the chisel shaft 422 forward and for a first of the contact elements 450 to ride through a first of the grooves 442 and into an adjacent second of the grooves 442, a portion of the reciprocating action imparted to the first impact surface is converted into combined reciprocation and rotation of the tool 410.

Figure 15:
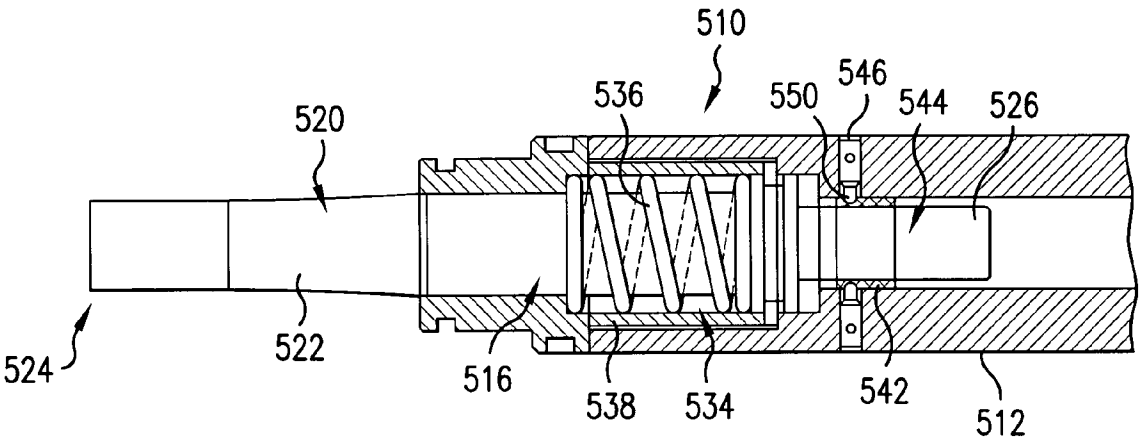
FIG. 15 is a fragmentary side view schematic, similar to FIG. 9, of a steerable ground piercing tool in accordance with another embodiment of the invention, with the tool in a relaxed position.
Figure 16:
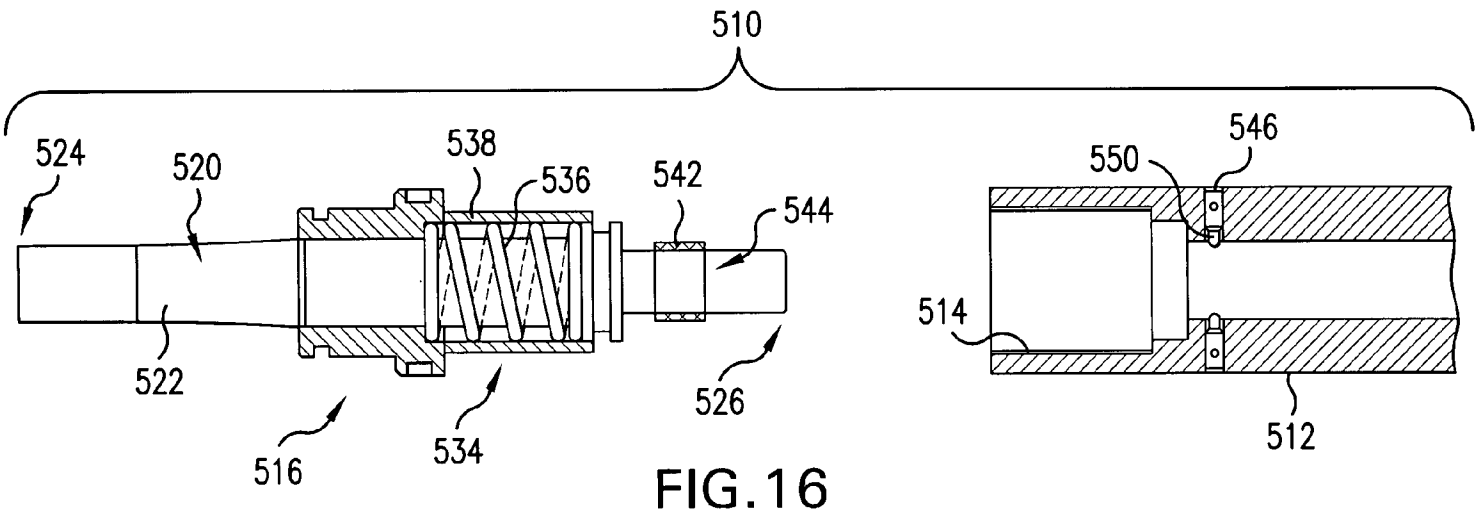
FIG. 16 is a partially exploded side view schematic, similar to FIG. 10, of the steerable ground piercing tool shown in FIG. 15.

While the invention has been described above making reference to an embodiment wherein the spring housing at least in part contains a ratcheting mechanism to interact with the series of parallel grooves formed in the chisel shaft and with the contact elements 450 forwardly disposed relative to the spring element 436, the broader practice of the invention is not necessarily so limited. For example, FIGS. 15 and 16 illustrate a steerable ground piercing tool 510 in accordance with another embodiment of the invention. The steerable ground piercing tool 510 is generally similar to the steerable ground piercing tool 410 described above in that it includes a mole body or outer housing 512, having or forming a bore 514, and an inner assembly 516 at least in part disposed within the outer housing 512. The inner assembly 516 includes a rotatable chisel 520 having a longitudinally extending shaft 522 at least in part disposed within the housing bore 514. The chisel 520 has a first end 524 defining an asymmetric tip and a second end 526 defining a first impact surface for receiving a reciprocating action impact to drive the tool 510 through the ground. The steerable ground piercing tool 510 also similarly includes a spring assembly 534 disposed at least in part within the tool outer housing 512. The spring assembly 534 includes a spring element 536 within a spring housing 538 disposed about the rotatable chisel 520.

While the chisel shaft 522 of the tool 510 has a similar series of parallel grooves 542 formed therein, these grooves are formed on a tail end portion 544 of the chisel shaft 522. Further, in the tool 510, it is the tool outer housing 512 that least in part includes a ratcheting mechanism 546 to interact with the series of parallel grooves 542 formed in the chisel shaft 522. More particularly, the ratcheting mechanism 546 is generally composed of a plurality of contact elements 550, such as in the form of round nose spring plungers, disposed about an inner circumference of the tool outer housing 512. Thus, in the tool 510, the contact elements are rearwardly disposed relative to the spring element.

For the ratcheting action of the tools 410 and 510 to work properly, it is important that the grooves be machined into or otherwise formed on the shaft at a specific axial distance from the shoulder that defines the fully retracted position of the shaft. In addition, the groove slope is important. Too steep of a slope could cause the spring plungers to come to rest too far back, and the plungers could run out of travel prior to climbing over the particular groove crest.

Where the grooves are machined or cut into a shaft along a straight path, un-machined flats may be formed on the beginning of the forward stroke instead of a more defined edge that defines the end of the forward stroke and the beginning of the next ratcheting groove. Unfortunately, it is more difficult to ensure that an associated contact element has managed to climb over a groove crest and land at the next groove during a stroke when a wide un-machined area is present as compared with a more defined groove edge.

Figure 17:
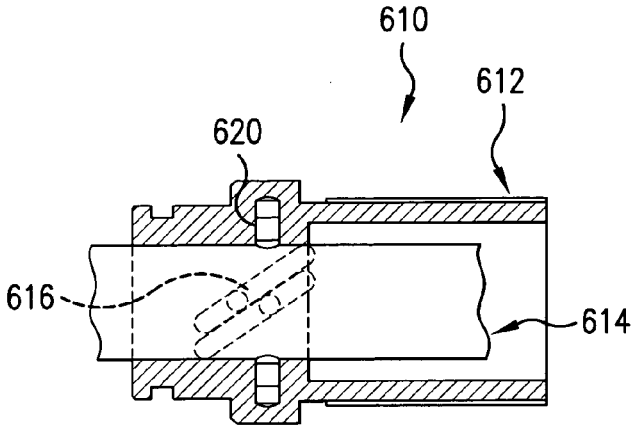
FIG. 17 is a simplified side view schematic of a fragmentary portion an alternative embodiment of a steerable ground piercing tool of the invention employing an internal detent.
Figure 18:
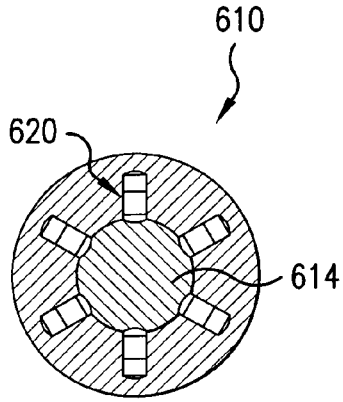
FIG. 18 is a simplified cross sectional view of the internal detent assembly of the steerable ground piercing tool shown in FIG. 17.

To reduce, minimize or overcome this potential limitation, an alternative embodiment of the invention utilizes helical grooves cut into the circumference of the shaft Making reference to FIGS. 17 and 18, there is shown a portion of an alternative embodiment of a steerable ground piercing tool 610 of the invention employing an internal detent.

More particularly, the tool 610 includes a spring housing 612 and a chisel shaft 614 having helical grooves 616 formed therein.

The tool 610 also employs internally mounted spring detents with steel rollers 620 mounted at their tip in place of plunger as in the above-described embodiment. Holes 622 to receive the detent balls are cut into the spring housing 612 from inside the bore such as through the use of an internal drilling process. As a result of such design permitting the use of larger diameter steel balls or rollers, such design can desirably increase or improve performance reliability. Further, such a design may desirably result in a stronger housing formed about the rotatable chisel as well as avoid potential damage to plungers such as may be a concern particularly where the tool is being utilized in an abrasive soil.

Figure 19:
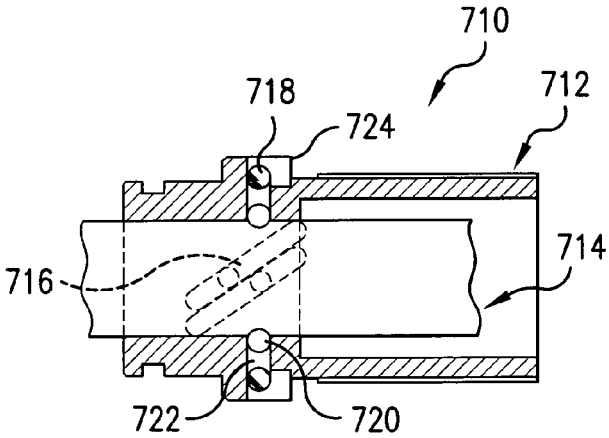
FIG. 19 is a simplified side view schematic of a fragmentary portion an alternative embodiment of a steerable ground piercing tool, similar to that shown in FIG. 17, but now utilizing a O-ring form of detent.
Figure 20:
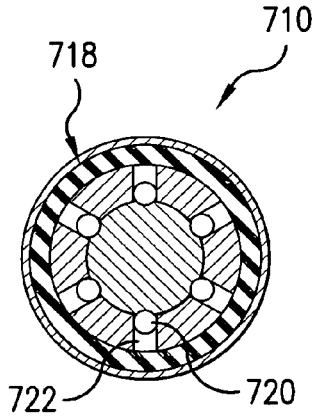
FIG. 20 is a simplified cross sectional view, similar to that shown in FIG. 18, of the steerable ground piercing tool shown in FIG. 19.

Turning to FIGS. 19 and 20, there is shown a portion of an alternative embodiment of a steerable ground piercing tool 710 of the invention employing an internal detent. More particularly, the tool 710 includes a spring housing 712 and a chisel shaft 714 having helical grooves 716 formed therein.

The tool 710 differs from the tool 610 in that it utilizes one or more O-rings or like elements 718 to provide the desired spring force to steel balls 720. The steel balls 720 are separated from the O-rings using cylindrical spacers 722. The steel balls 720, spacers 722 and O-rings are held in place by a cover 724 such as may be pressed into place over the spring housing 712. Such assembly permits the steel balls 720 to move in and out radially as the balls move along the grooves in the chisel shaft 714.

The use of contact elements in the form of rollers or balls, as in the tools 610 and 710, respectively, and which contact elements are free to rotate within their seats greatly reduce the resulting contact forces when compared to embodiments that utilize fixed contact elements. Furthermore, the utilization of contact elements in the form of relatively larger diameter rollers or balls, as compared to the relatively small pinhead design spring plungers in previously described embodiments can desirably enhance the mechanical strength of the resulting steerable ground piercing tool of the invention.

As will be appreciated, steerable ground piercing tools of the invention employing ratcheting-based mechanisms as herein described advantageously reduce or eliminate wear issues such as those that may be associated with designs point-to-point loading of teeth gears or the like. Further, with such ratcheting-based mechanisms, only two component parts need to be machined and both such parts are relatively easy to fabricate. By reducing the number of required component parts and simplifying design and/or manufacture thereof, the cost of manufacture and production can be significantly reduced. Furthermore, by reducing the number of required components, the mass of the tool, particularly the tip end portion thereof can very nearly match that of a similar-sized ground piercing tool that does not include the steerability feature of the invention. Such size similarity can advantageously facilitate implementation of such steerable ground piercing tools in existing or present ground piercing operating assemblies.

As will be appreciated by those skilled in the art and guided by the teachings herein provided, steerable ground piercing tools in accordance with the invention may desirably include, contain or incorporate one or more magnets or the like elements to permit or facilitate the above-ground detection of rotation of the tip of the tool.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A steerable ground piercing tool, the tool comprising:

an elongated outer housing having a lengthwise extending bore;

an inner assembly at least in part disposed within the outer housing, the inner assembly comprising;

a rotatable chisel having a longitudinally extending shaft at least in part disposed within the housing bore, the chisel having a first end defining an asymmetric tip and a second end defining a first impact surface for receiving a reciprocating action impact to drive the tool through the ground; and a conversion mechanism to selectively convert upon activation thereof at least a first portion of the reciprocating action imparted to the first impact surface into combined reciprocation and rotation of the tool; and a spring assembly disposed at least in part within the tool outer housing to move the rotatable chisel to an at rest state in the absence of imparting of impacts thereon, the spring assembly comprises a spring element within a spring housing disposed about the rotatable chisel, wherein the conversion mechanism comprises:

the chisel shaft having a circumference with a series of parallel grooves formed therein and a selected one of the spring housing and the tool outer housing comprises a ratcheting mechanism to interact with the series of parallel grooves formed in the chisel shaft, wherein the ratcheting mechanism comprises:

a plurality of contact elements disposed about an inner circumference of the selected one of the spring housing and the tool outer housing with a different one of the contact elements in interaction contact with a different one of the series of parallel grooves formed in the chisel shaft, and wherein the impacts imparted to the second end of the chisel are sufficient to advance the chisel shaft forward and for a first of the contact elements to ride through a first of the grooves and into an adjacent second of the grooves to convert a portion of the reciprocating action imparted to the first impact surface into combined reciprocation and rotation of the tool.

2. The tool of claim 1 wherein at least one of the contact elements comprises a spring plunger.

3. The tool of claim 1 wherein at least one of the contact elements comprises a combination of a spring detent and a roller element.

4. The tool of claim 3 wherein the spring detent comprises an O-ring element.

5. The tool of claim 1 wherein the contact elements are forwardly disposed relative to the spring element.

6. The tool of claim 1 wherein the contact elements are rearwardly disposed relative to the spring element.

7. The combination of the tool of claim 1 with a compressed fluid distribution system to impart reciprocating action in response to a supply of compressed fluid, wherein, the fluid is alternatively selectively compressed to either:

a sufficiently high pressure to convert the first portion of the reciprocating action imparted to the first impact surface into combined reciprocation and rotation of the tool and the tool pierces the ground in a straight path, or an insufficiently high pressure to convert the first portion of the reciprocating action imparted to the first impact surface into combined reciprocation and rotation of the tool.

* * * * *